US008664841B2

(12) United States Patent
Wang

(10) Patent No.: US 8,664,841 B2
(45) Date of Patent: Mar. 4, 2014

(54) ILLUMINATIVE CLIPPER STRUCTURE

(76) Inventor: Shui-Chin Wang, Taichung County (TW)

( * ) Notice: Subject to any disclaimer, the term of this patent is extended or adjusted under 35 U.S.C. 154(b) by 616 days.

(21) Appl. No.: 12/837,516

(22) Filed: Jul. 16, 2010

(65) Prior Publication Data

US 2012/0014096 A1 Jan. 19, 2012

(51) Int. Cl.
*B25B 23/18* (2006.01)

(52) U.S. Cl.
USPC ..... 313/119

(58) Field of Classification Search
USPC ..... 362/119
See application file for complete search history.

(56) References Cited

U.S. PATENT DOCUMENTS

| | | | | |
|---|---|---|---|---|
| 5,678,919 | A * | 10/1997 | Huang | 362/119 |
| 6,296,365 | B1 * | 10/2001 | McCalla et al. | 362/119 |
| 7,399,101 | B2 * | 7/2008 | Clausen et al. | 362/119 |
| 2006/0158871 | A1 * | 7/2006 | Hopkins et al. | 362/119 |

* cited by examiner

*Primary Examiner* — Anh Mai
*Assistant Examiner* — Hana Featherly

(57) ABSTRACT

An illuminative clipper structure contains a body including a first and a second support arms axially connected together, the first support arm including a recessed area arranged on an outer wall thereof, a first and a second recesses communicating with the recessed area; a first sleeve fitted on the first support arm and including a chamber formed on an inner wall thereof, and an aperture to communicate with the chamber; an illuminating assembly including a holder placed in the chamber to receive cells and supply power toward a bulb to emit lights, a wire coupled with the holder and the bulb, the wire being inserted into the aperture from the first recess so that the bulb is located at a second recess of the body; a protective cover covered onto the recessed area to fix the bulb so that the bulb emits lights to a movable opening of a clipper.

9 Claims, 12 Drawing Sheets

ILLUMINATIVE CLIPPER STRUCTURE

BACKGROUND OF THE INVENTION

1. Field of the Invention

The present invention relates to clippers, and more particularly to an illuminative clipper structure.

2. Description of the Prior Art

A conventional illuminative hand tool disclosed in U.S. Pat. No. 6,296,365 includes a handle 1 having a chamber 2 formed therein to receive a holder 3 and a bulb 4 connected with the holder 3 so that a plurality of cells 5 are placed in the holder 3 to make the bulb 4 emit lights to illuminate an opening of the hand tool through a hose 6 in the handle 1. However, the handle 1 has to be include the chamber 2 and the hose 6, having a complicate production process and high production cost. Furthermore, the lights are emitted through the hose 6, having a weak illumination.

Referring to FIGS. 2 and 3, a conventional pliers disclosed in U.S. Pat. No. 7,399,101 B2 includes two handles 10 having a connecting portion 11 to match with a hollow structure, and after the handles 10 are connected together, the connecting portion 11 are provided with a vertical hole 12 and a horizontal hole 13, and the horizontal hole 13 includes an illuminating assembly 14 placed therein, two support seats 15 are used to retain the illuminating assembly 14 and fixed by screws so that lights are emitted from an opening 16 of pliers.

Nevertheless, the illuminating assembly 14 is fixed in the connecting portion 11, so a groove to receive the connecting portion 11 is essential that will bear most operating pressure to lower operative torque, thereby damaging the pliers easily.

The present invention has arisen to mitigate and/or obviate the afore-described disadvantages.

SUMMARY OF THE INVENTION

The primary object of the present invention is to provide an illuminative clipper structure that the chamber and the aperture for matching with the illuminating assembly are not formed in a rigid grip of the conventional clipper to simplify production process and cost, and the wire of the illuminating assembly is arranged on an outer surface of the body to simplify production process and lower production time.

Further object of the present invention is to provide an illuminative clipper structure that the bulb of the illuminating assembly is located at the second recess of the body close to the opening of the clipper so as to illuminate a workpiece clearly and brightly.

Another object of the present invention is to provide an illuminative clipper structure that the first and the second support arms of the body are connected together axially so that an installation of the wire and the bulb does not influence a torque of the body.

To obtain the above objective, an illuminative clipper structure contains:

a body including a first support arm and a second support arm, both of which are axially connected together, and the first support arm including a recessed area arranged on an outer wall thereof adjacent to a movable opening of a clipper, a first recess communicating with the recessed area and a second recess communicating with the recessed area;

a first sleeve fitted on the first support arm and including a chamber formed on an inner wall thereof, and an aperture to communicate with the chamber;

an illuminating assembly including a holder, a wire, and a bulb, wherein the holder is placed in the chamber of the first sleeve to receive a number of cells and supply power from the cells to the bulb to emit lights, one end of the wire is coupled with the holder, and another end of the wire is connected with the bulb, the wire is inserted into the aperture of the first sleeve from the first recess of the body so that the bulb is located at a second recess of the body;

a protective cover covered onto the recessed area of the body to fix the bulb so that the bulb emits lights to the opening of the clipper clearly.

DETAILED DESCRIPTION OF THE PREFERRED EMBODIMENTS

Figure 1:
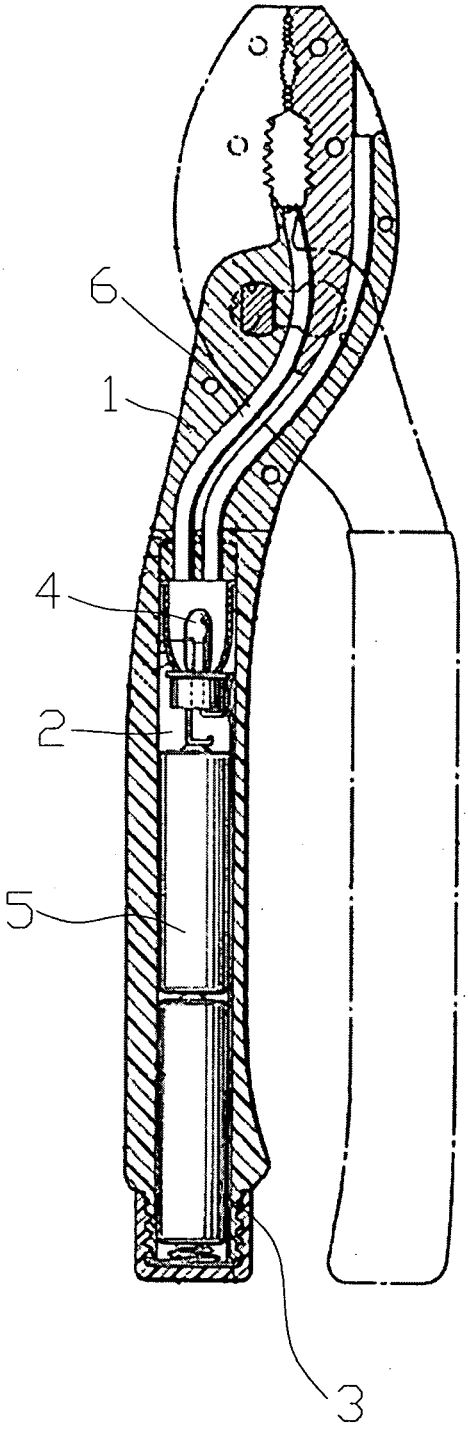
F I G.1 Prior Art
FIG. 1 is a cross sectional view of a conventional illuminative clippers.
Figure 2:
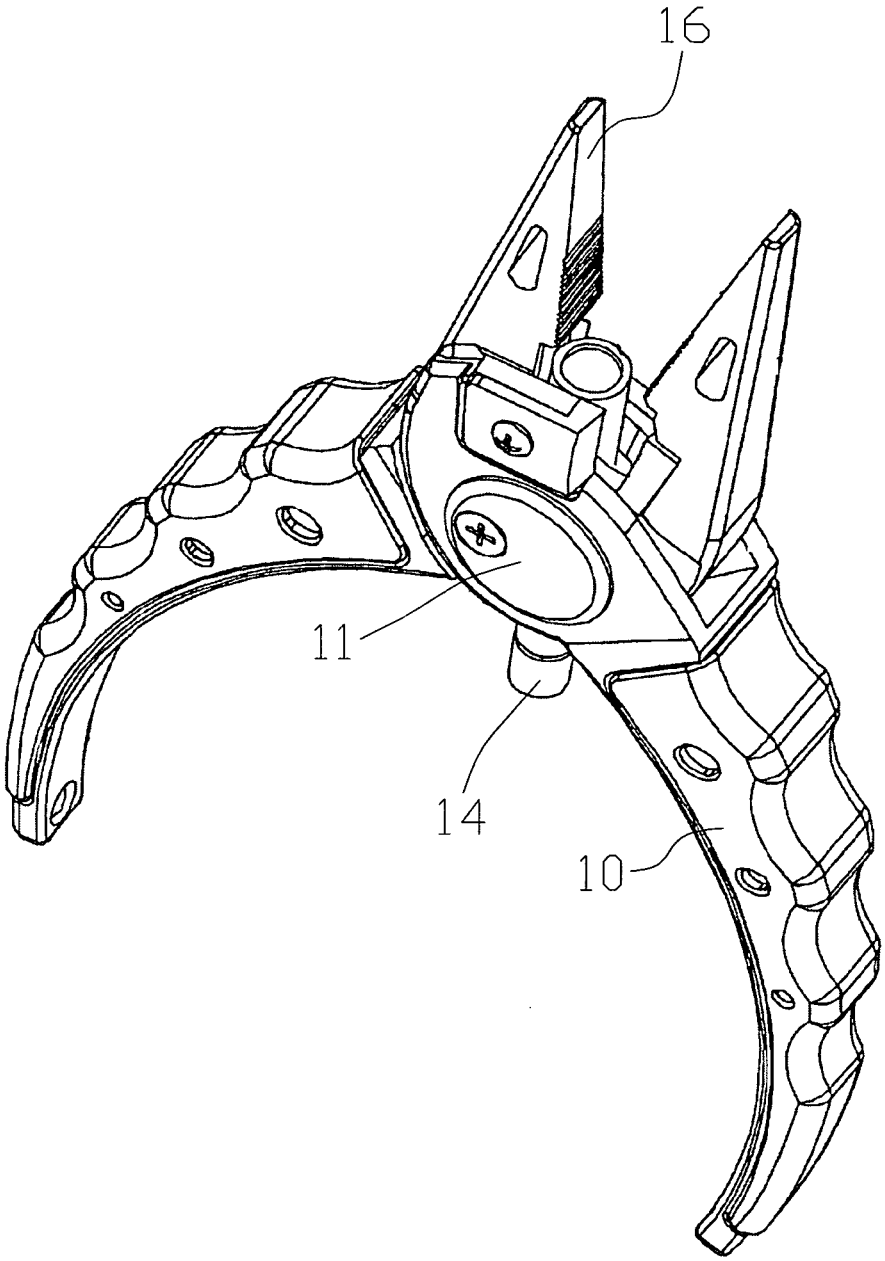
F I G.2 Prior Art
FIG. 2 is a perspective view showing the assembly of another conventional illuminative clipper.
Figure 3:
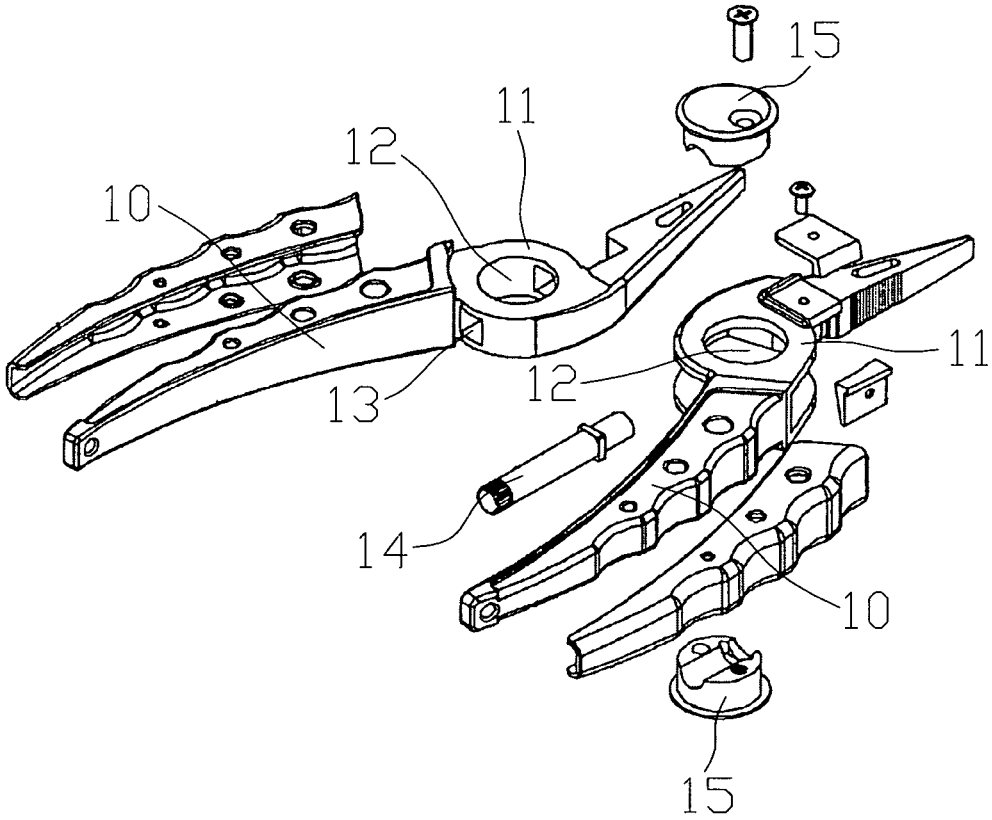
F I G.3 Prior Art
FIG. 3 is a perspective view showing the exploded components of the another conventional illuminative clipper.

The present invention will be clearer from the following description when viewed together with the accompanying drawings, which show, for purpose of illustrations only, the preferred embodiment in accordance with the present invention.

Referring to FIGS. 4-10, an illuminative clipper structure 100 in accordance with a preferred embodiment of the present invention comprises a body 20, a first sleeve 30, a second sleeve 40, an illuminating assembly 50, and a protective cover 60.

Figure 4:
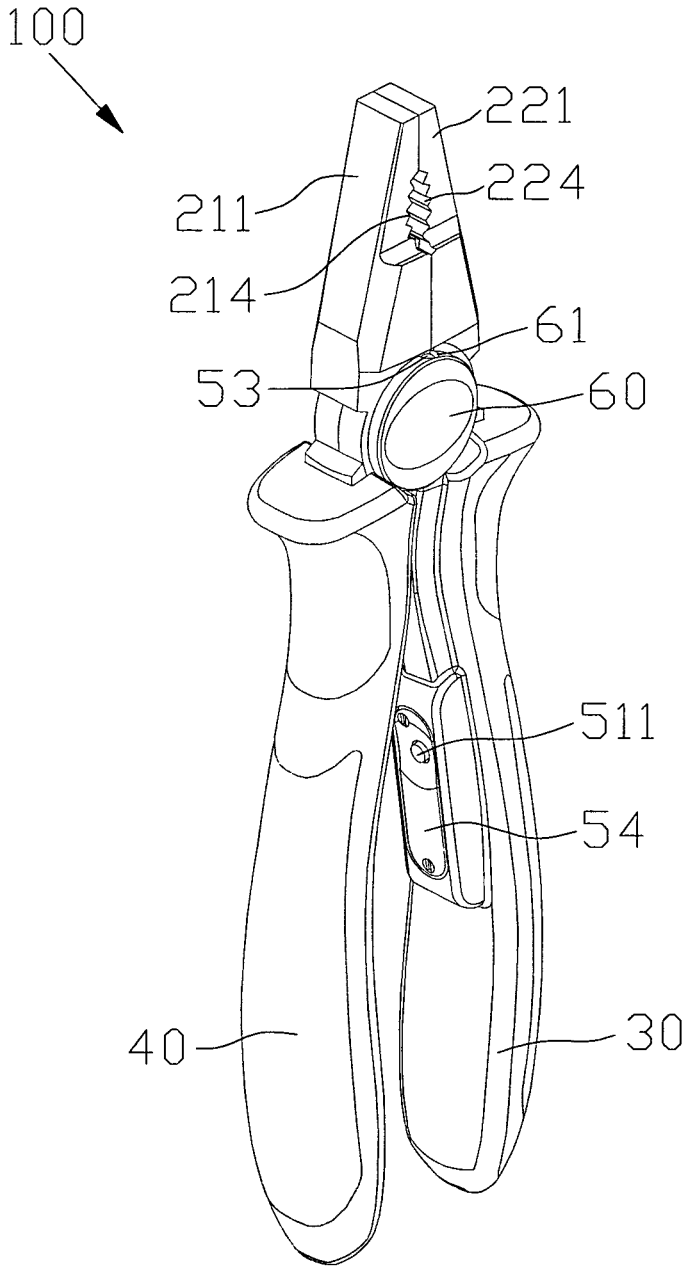
FIG. 4 is a perspective view showing the assembly of an illuminative clipper structure according to a preferred embodiment of the present invention.
Figure 5:
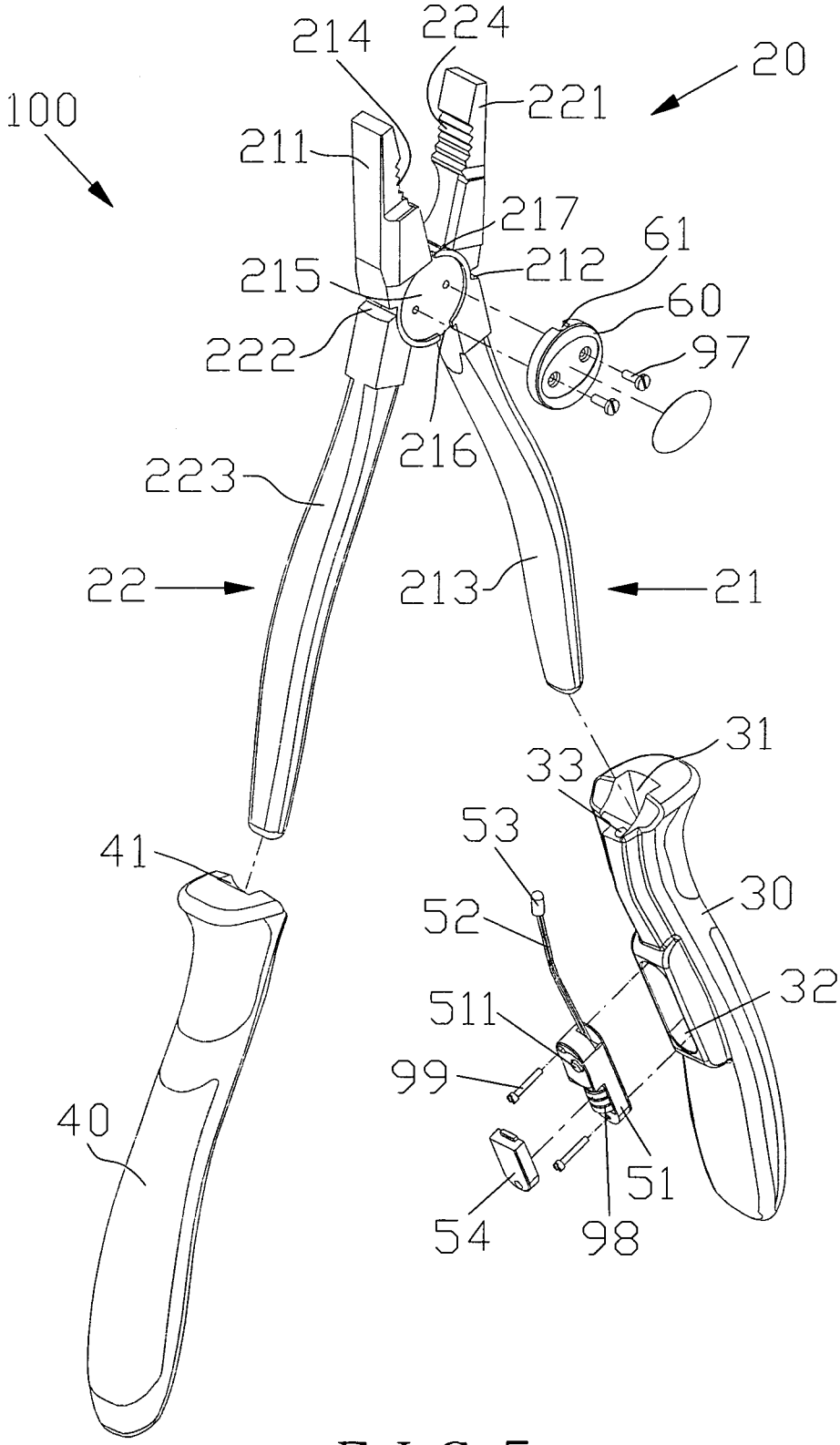
FIG. 5 is a perspective view showing the exploded components of the illuminative clipper structure according to the preferred embodiment of the present invention.
Figure 6:
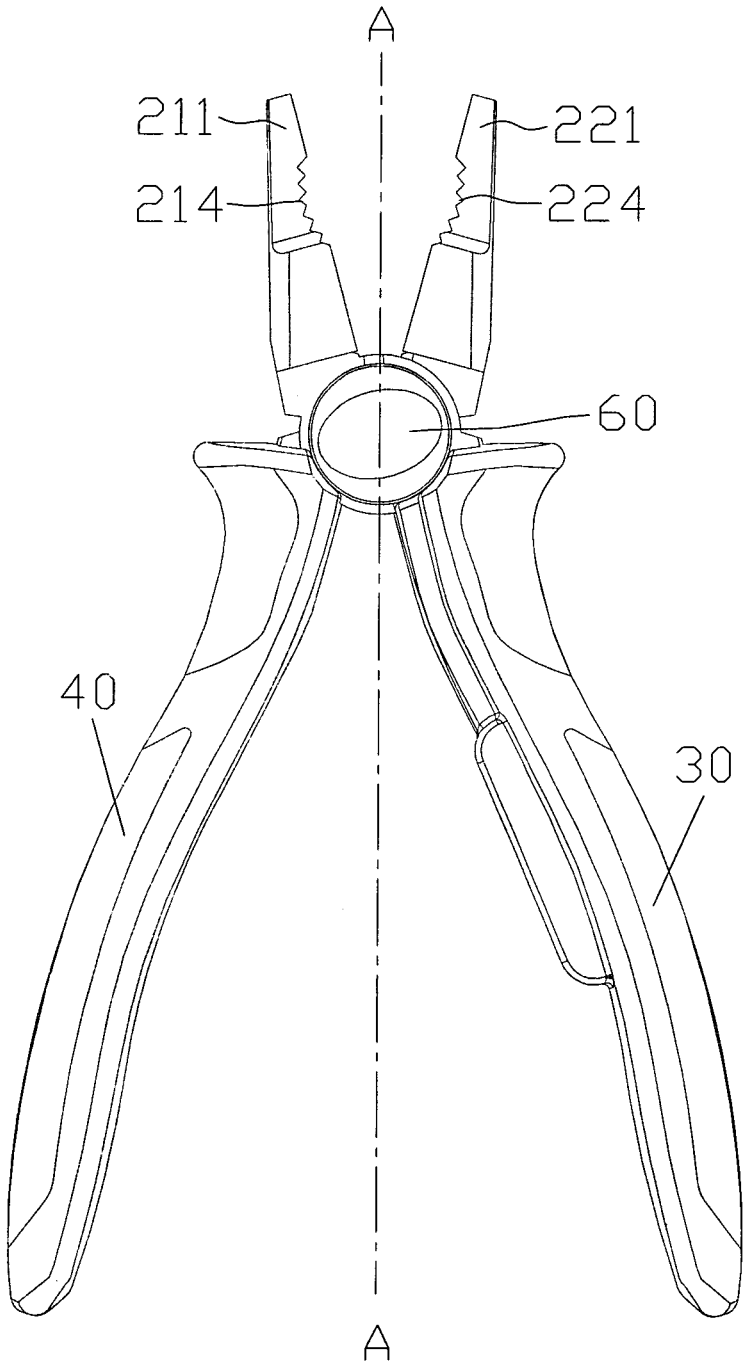
FIG. 6 is a plan view showing the assembly of the illuminative clipper structure according to the preferred embodiment of the present invention.
Figure 7:
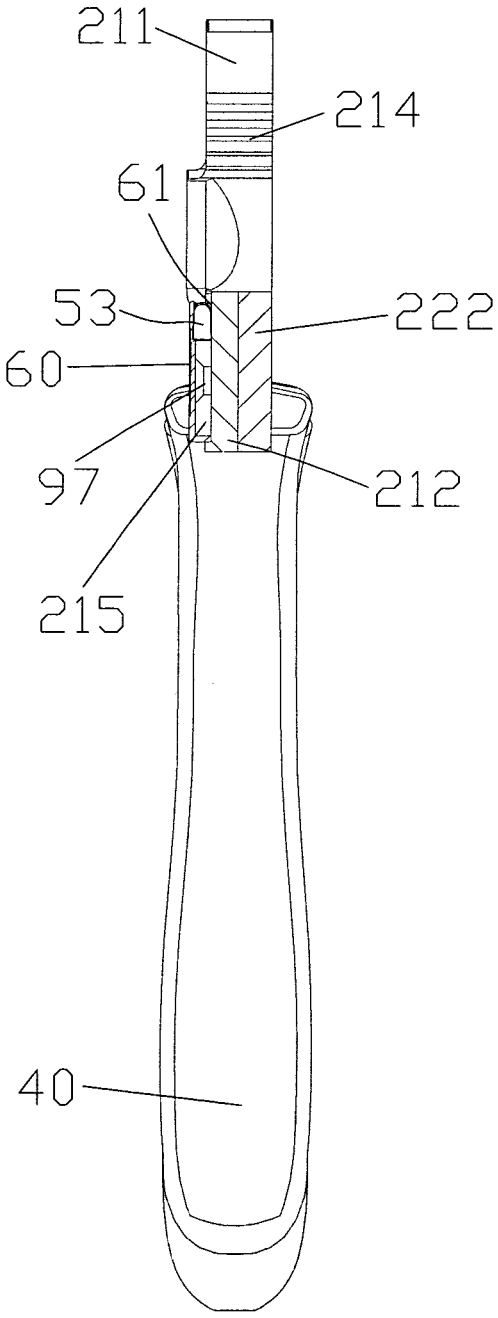
FIG. 7 is a cross sectional view taken along line of A-A of FIG. 6.
Figure 8:
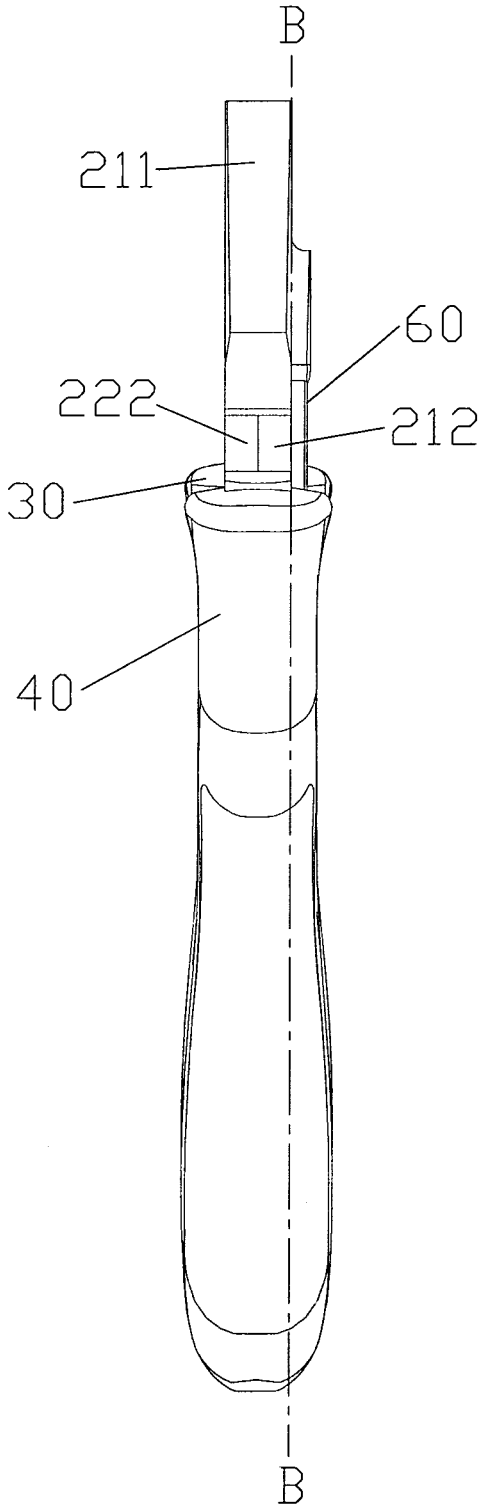
FIG. 8 is a cross sectional view of FIG. 4.

As shown in FIGS. 4 and 5, the body 20 includes a first support arm 21 and a second support arm 22, and the first support arm 21 includes a first head section 211 disposed on an upper side thereof, a first connecting section 212 defined between the first head section 211 and a first gripping section 213 thereof, and the first gripping section 213 mounted on a lower side thereof, the first head section 211 includes a first toothed portion 214 formed on an inner wall thereof, and the first connecting section 212 includes a recessed area 215 arranged on an outer wall thereof, the recessed area 215 includes a first recess 216 facing to the first gripping section 213 and a second recess 217 facing to the first head section 211; the second support arm 22 includes a second head section 211 fixed on an upper side thereof, a second connecting section 222 defined between the second head section 221 and a second gripping section 223 thereof, and the second gripping section 223 secured on a lower side thereof, the second head section 221 includes a second toothed portion 224 formed on an inner wall thereof, and the second connecting section 222 of the second support arm 22 is axially connected with the first connecting section 212 of the first support arm 21 so that a movable opening of the clipper is formed between the first and the second head sections 211, 221.

Also referring to FIGS. 4 and 5, the first sleeve 30 is made of rubber material and includes a first hole 31 to receive the first gripping section 213 of the body 20, includes a chamber 32 formed on an inner wall thereof, and an aperture 33 to communicate with the chamber 32.

The second sleeve 40 is made of rubber material and includes a second hole 41 to receive the second gripping section 223 of the body 20.

The illuminating assembly 50 includes a holder 51, a wire 52, a bulb 53 and a lip 54, wherein the holder 51 is placed in the chamber 32 of the first sleeve 30 and fixed by a plurality of locking elements 99 to receive a number of cells 98, and one end of the wire 52 is coupled with the holder 51 to supply power from the cells 98, and the bulb 53 is connected with another end of the wire 52 so as to be supplied with the power from the cells 98 to emit lights, the lip 54 is fixed on the holder 51 to prevent the cells 98 from disengaging from the holder 51, and the wire 52 is inserted into the aperture 33 of the first sleeve 30 from the first recess 216 of the body 20 so that the bulb 53 is located at the second recess 271; wherein the holder 51 includes a button 511 disposed thereon to power on/off the bulb 53 to emit lights.

Figure 9:
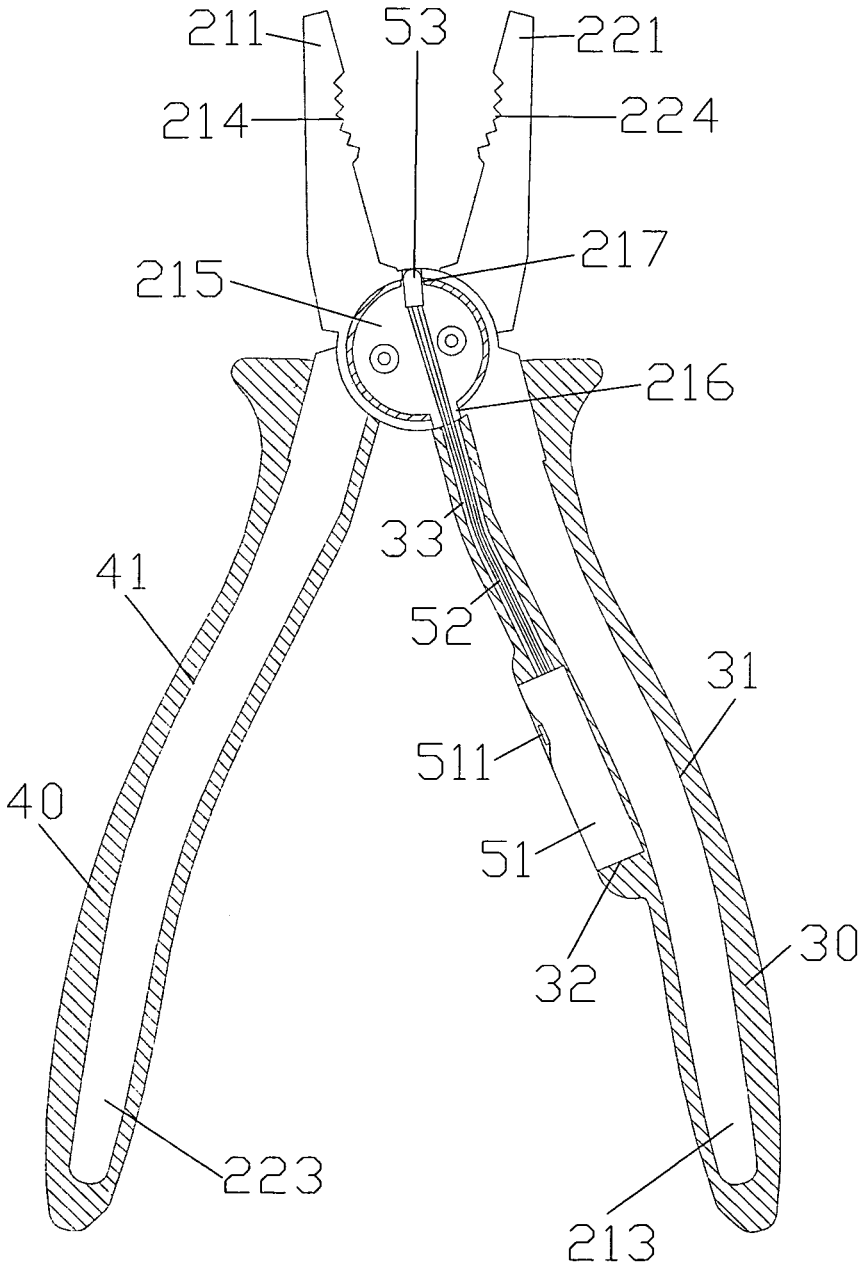
FIG. 9 is a cross sectional view taken along line of B-B of FIG. 8.
Figure 10:
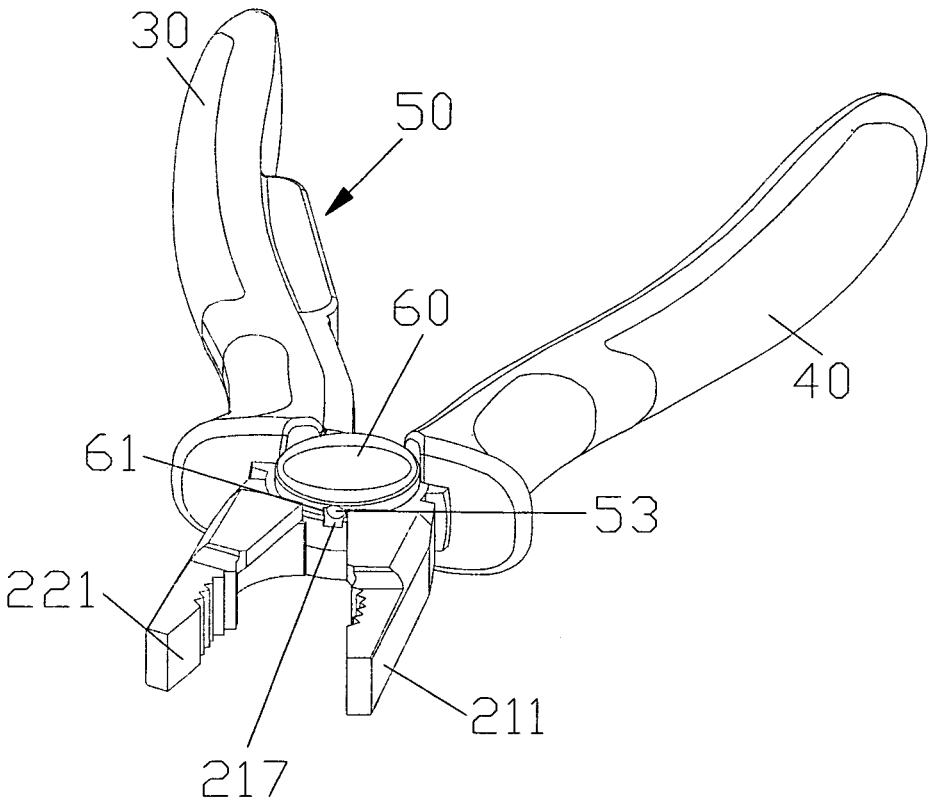
FIG. 10 is another perspective view showing the assembly of the illuminative clipper structure according to the preferred embodiment of the present invention.

As illustrated in FIGS. 4-10, the protective cover 60 is covered onto the recessed area 215 of the body 20 and fixed by using a plurality of screwing elements 97, and includes an upper groove 61 and a lower groove (not shown), and the lower groove is inserted by the wire 52 of the illuminating assembly 50, the upper groove 61 is used to fix the bulb 53 so that the bulb 53 emits lights to illuminate the opening of the clipper (as shown in FIGS. 9 and 10).

Because the first sleeve 30 is made of rubber material, the chamber 32 and the aperture 33 for matching with the illuminating assembly 50 are not formed in a rigid grip of the conventional clipper to simplify production process and cost.

In addition, the wire 52 of the illuminating assembly 50 is arranged on an outer surface of the body 20 to simplify production process and lower production time.

The bulb 53 of the illuminating assembly 50 is located at the second recess 217 of the body 20 close to the opening of the clipper so as to illuminate a workpiece clearly and brightly.

The first and the second support arms 21, 22 of the body 20 are connected together axially so that an installation of the wire 52 and the bulb 53 does not influence a torque of the body 20.

Figure 11:
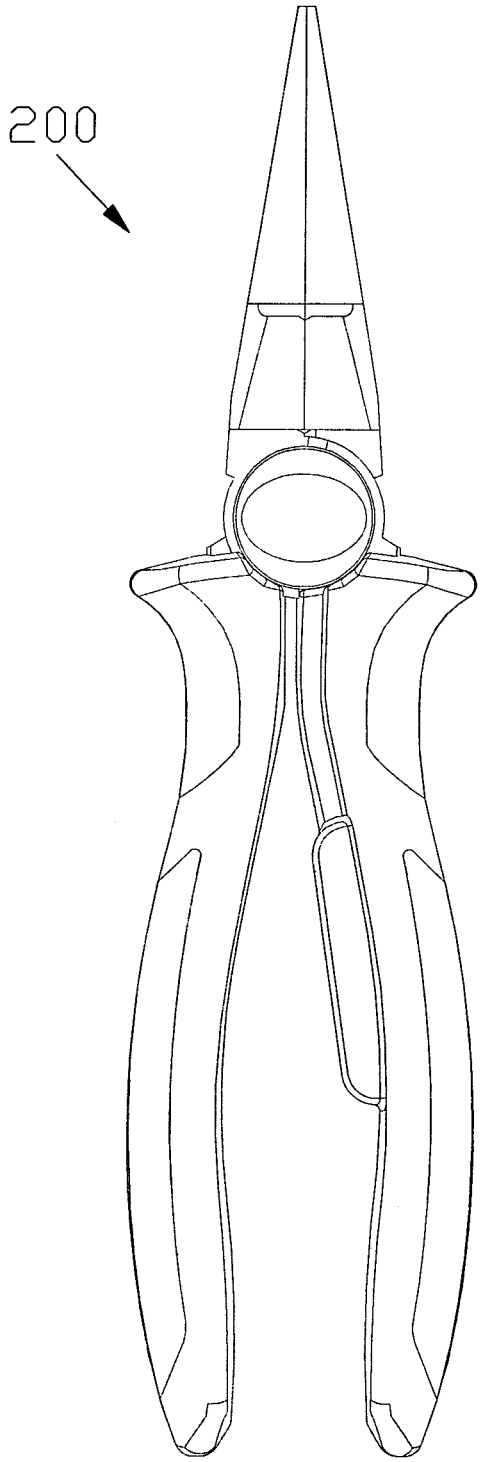
FIG. 11 is a perspective view showing another illuminative clipper structure according to the preferred embodiment of the present invention.
Figure 12:
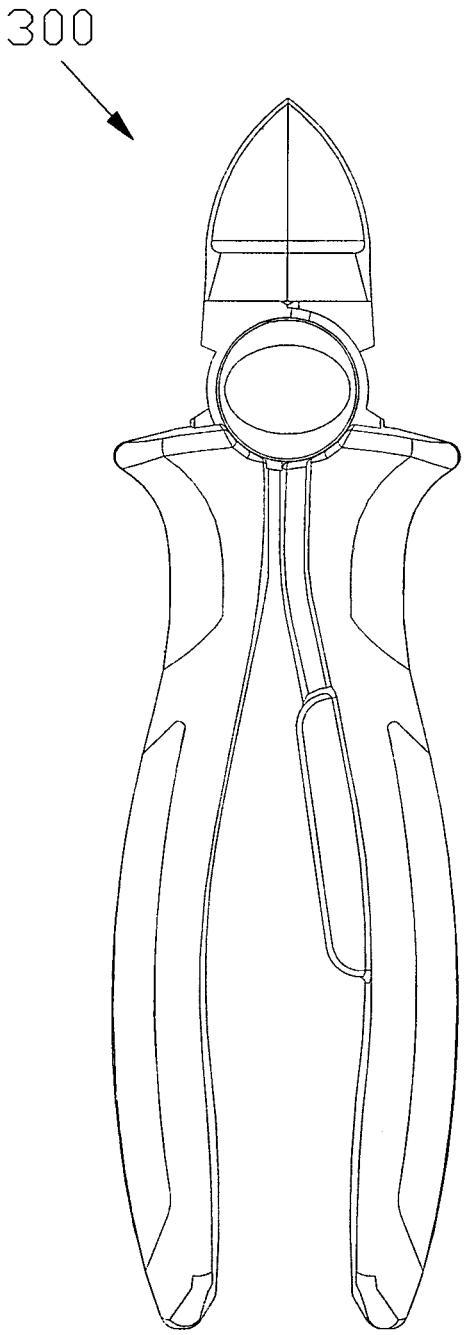
FIG. 12 is a perspective view showing another illuminative clipper structure according to the preferred embodiment of the present invention.

Moreover, the body 20 of the illuminative clipper structure 100 is widely applied in vices, nose pliers 200 as shown in FIG. 11, and cutting pliers 300 as illustrated in FIG. 12.

While we have shown and described various embodiments in accordance with the present invention, it is clear to those skilled in the art that further embodiments may be made without departing from the scope of the present invention.

What is claimed is:

1. An illuminative clipper structure comprising:

a body including a first support arm and a second support arm, both of which are axially connected together, and the first support arm including a first head section disposed on an upper side thereof and a first connecting section defined between the first head section and a first gripping section thereof, the first connecting section includes a recessed area arranged on an outer wall thereof adjacent to a movable opening of a clipper, the recessed area including a first recess facing to the first gripping section and communicating with the recessed area, and the recessed area including a second recess facing to the first head section and communicating with the recessed area;

a first sleeve fitted on the first support arm and including a chamber formed on an inner wall thereof, and an aperture to communicate with the chamber;

an illuminating assembly including a holder, a wire, and a bulb, wherein the holder is placed in the chamber of the first sleeve to receive a number of cells and supply power from the cells to the bulb to emit lights, one end of the wire is coupled with the holder, and another end of the wire is connected with the bulb, the wire is inserted into the aperture of the first sleeve from the first recess of the body and the bulb is located at the second recess of the recessed area of the first connecting section of the first support arm;

a protective cover covered onto the recessed area of the body to fix the bulb, and the bulb emits lights to the opening of the clipper clearly between the first head section and the second head section;

wherein the protective cover includes an upper groove and a lower groove, and the lower groove is inserted by the wire of the illuminating assembly, the upper groove is used to fix the bulb so that the bulb emits lights to illuminate the opening of the clipper.

2. The illuminative clipper structure as claimed in claim 1, and the first gripping section mounted on a lower side thereof; the first head section includes a first toothed portion formed on an inner wall thereof, and the first sleeve is fitted on the first gripping section; the second support arm includes a second head section fixed on an upper side thereof, a second connecting section defined between the second head section and a second gripping section thereof, and the second gripping section secured on a lower side thereof, the second head section includes a second toothed portion formed on an inner wall thereof, and the second connecting section of the second support arm is axially connected with the first connecting section of the first support arm so that the movable opening of the clipper is formed between the first and the second head sections.

3. The illuminative clipper structure as claimed in claim 1, wherein the first sleeve is made of rubber material.

4. The illuminative clipper structure as claimed in claim 1, wherein the first sleeve includes a first hole to receive the first gripping section of the body.

5. The illuminative clipper structure as claimed in claim 1 further comprising the second sleeve fitted on the second support arm.

6. The illuminative clipper structure as claimed in claim 1, wherein the holder is placed in the chamber of the first sleeve and fixed by a plurality of locking elements.

7. The illuminative clipper structure as claimed in claim 1, wherein the illuminating assembly includes a lip fixed on the holder to prevent the cells from disengaging from the holder.

8. The illuminative clipper structure as claimed in claim 1, wherein the holder includes a button disposed thereon to power on/off the bulb to emit lights.

9. The illuminative clipper structure as claimed in claim 1, wherein the body of the illuminative clipper structure is applied in vices, nose pliers, and cutting pliers.

* * * * *